US007126557B2

(12) United States Patent
Warnagiris

(10) Patent No.: US 7,126,557 B2
(45) Date of Patent: Oct. 24, 2006

(54) TAPERED AREA SMALL HELIX ANTENNA

(75) Inventor: Thomas J. Warnagiris, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 10/956,565

(22) Filed: Oct. 1, 2004

(65) Prior Publication Data

US 2006/0071873 A1 Apr. 6, 2006

(51) Int. Cl.
*H01Q 1/36* (2006.01)
*H01Q 1/42* (2006.01)

(52) U.S. Cl. ..... 343/895; 343/872

(58) Field of Classification Search ..... 343/872, 343/895, 846, 848
See application file for complete search history.

(56) References Cited

U.S. PATENT DOCUMENTS

| | | | | |
|---|---|---|---|---|
| 2,826,756 | A | 3/1958 | Cary | 343/708 |
| 3,868,694 | A | 2/1975 | Meinke | 343/753 |
| 4,148,030 | A | 4/1979 | Foldes | 343/895 |
| 4,169,267 | A | 9/1979 | Wong et al. | 343/895 |
| 4,649,396 | A | 3/1987 | Friedman | 343/705 |
| 4,697,192 | A | 9/1987 | Hofer et al. | 343/895 |
| 5,216,436 | A | 6/1993 | Hall et al. | 343/895 |
| 5,349,365 | A | 9/1994 | Ow et al. | 343/895 |
| 5,479,182 | A | 12/1995 | Sydor | 343/895 |
| 5,668,559 | A | 9/1997 | Baro | 343/702 |
| 5,892,480 | A | 4/1999 | Killen | 343/385 |
| 6,150,984 | A | 11/2000 | Suguro et al. | 343/702 |
| 6,278,414 | B1 | 8/2001 | Filipovic et al. | 343/895 |
| 6,339,409 | B1 * | 1/2002 | Warnagiris | 343/895 |

FOREIGN PATENT DOCUMENTS

GB 322614 12/1929

* cited by examiner

*Primary Examiner*—Shih-Chao Chen
(74) *Attorney, Agent, or Firm*—Baker Botts L.L.P.

(57) ABSTRACT

A wideband multi-mode antenna having low VSWR operating characteristics. The antenna element is formed from a right-triangularly shaped piece of conductive material, which is rolled along the base dimension. Operational characteristics may be modified by spacing the antenna element from a ground plane using dielectric spacers, and the antenna element may be shorted to the ground plane.

28 Claims, 4 Drawing Sheets

TAPERED AREA SMALL HELIX ANTENNA

GOVERNMENT LICENSE RIGHTS

The U.S. Government has a paid-up license in this invention and the right in certain circumstances to require the patent owner to license others on reasonable terms as provided for by the terms of Contract No. DAAB07-03-C-K402 for the United States Army CECOM.

TECHNICAL FIELD OF THE INVENTION

This invention relates to antennas, and more particularly to an antenna based on a tapered helix configuration, and having low VSWR over a wide bandwidth and multi-mode operation.

BACKGROUND OF THE INVENTION

U.S. Pat. No. 6,339,409 B1, entitled "Wide Bandwidth Multi-Mode Antenna" to Thomas Warnagiris, describes a tapered area small helix antenna. Its design provides a low observable omni-directional antenna, with wide bandwidth and low VSWR. Although it has various embodiments, in a simple form, it can be simply made by rolling a right-triangle shaped conductive material into a spiral.

DETAILED DESCRIPTION OF THE INVENTION

Figure 1:
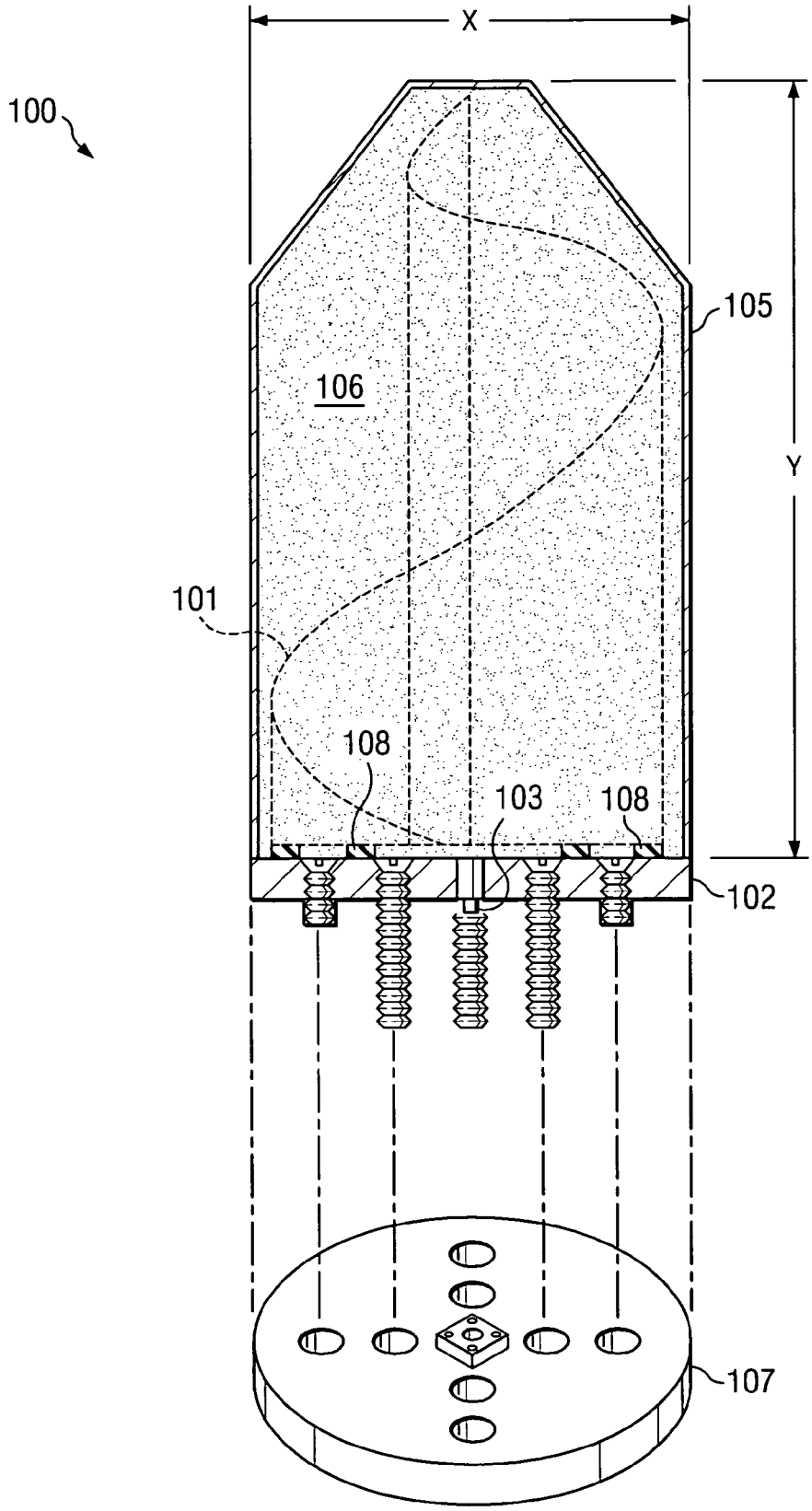
FIG. 1 illustrates an embodiment of the antenna having spacers between the antenna element and the ground plate.

FIG. 1 illustrates one embodiment of a wideband multi-mode antenna 100 in accordance with the invention. Except for various improvements described herein, antenna 100 has the same basic design as the antenna (and its various embodiments) described in U.S. Pat. No. 6,339,409 B1 referenced above and incorporated by reference herein. Essentially, the antenna element 101 is a helical structure, formed from planar material. Antenna 100 exhibits a low VSWR over a wide frequency range.

In the example of FIG. 1, antenna 100 is designed for 225 to 2000 MHz operation, with $\lambda$=1.333 m, where $\lambda$ is the wavelength of the low frequency of operation. This is but one embodiment of antenna 100, and various design parameters of antenna 100 can be modified for different frequency ranges. The following are the primary design parameters of antenna 100:

- W wire diameter (if planar mesh) or material thickness of antenna element 101
- C Base spiral configuration (spacing between turns, space variation, etc)
- Y height of antenna element 101
- X base length of material used for antenna element
- S spacing of the antenna element from the ground plane
- F feed point
- D diameter of the rolled antenna element As explained below, in other embodiments of antenna 100, these design parameters may be modified to achieve particular operational characteristics.

The material used for the antenna element 101 is copper mesh having a wire diameter of 0.047 inches and 4 mesh per inch. Unrolled material used to form the antenna element 101 was cut as a right triangle (X=base, Y=height) with Y determined by the low frequency f of the desired bandwidth. In this example, the values of X and Y are 16.5 and 10.2 inches, respectively. Variations of antenna 10 may be constructed with triangularly shaped material, where the hypotenuse is curved (concave or convex) rather than straight.

The spacing between the turns of antenna element 101 is held equal as the material is rolled. Various methods for rolling antenna element 101 are described below in connection with FIG. 4.

Antenna 100 is mounted on a metal plate 102, which provides a ground plane. In the example of FIG. 1, the ground plane to antenna spacing is 0.2 inches.

A feed wire 103 runs to the vertical (Y) edge of the antenna element. The feed point for maximum low VSWR bandwidth (one octave above the first resonance) is the innermost point of the base spiral.

In the example of FIG. 1, the antenna element 101 is mounted within a low loss radome 105, which stabilizes the turns spacing and provides a weather resistant shield. It may be made from a material such as plastic, and can be made rigid and durable to protect antenna element 101 from environmental conditions or stress.

The interior of the radome 105 is potted with a low loss dielectric foam filler 106, which fills the spacing between the turns of the antenna element 101. The dielectric filler 106 also serves to hold the spacing between turns.

Radome 105 is attached to ground plane 102, which may be bolted or otherwise attached to a base plate 107. Antenna 100 may then be attached to a vehicle or other surface, using various conventional antenna mounting devices.

As indicated in FIG. 1, spacers 108 are attached between the base of the antenna element 101 and ground plane 102. Spacers 108 are made from a dielectric material, such as Teflon, porcelain, or styrene. Spacers 108 can be discrete pieces attached with screws, glue, rivets, or other fastening means. Spacers 108 have a thickness that maintains the correct distance between the base of the antenna element 101 and the ground plane 102.

Figure 2:
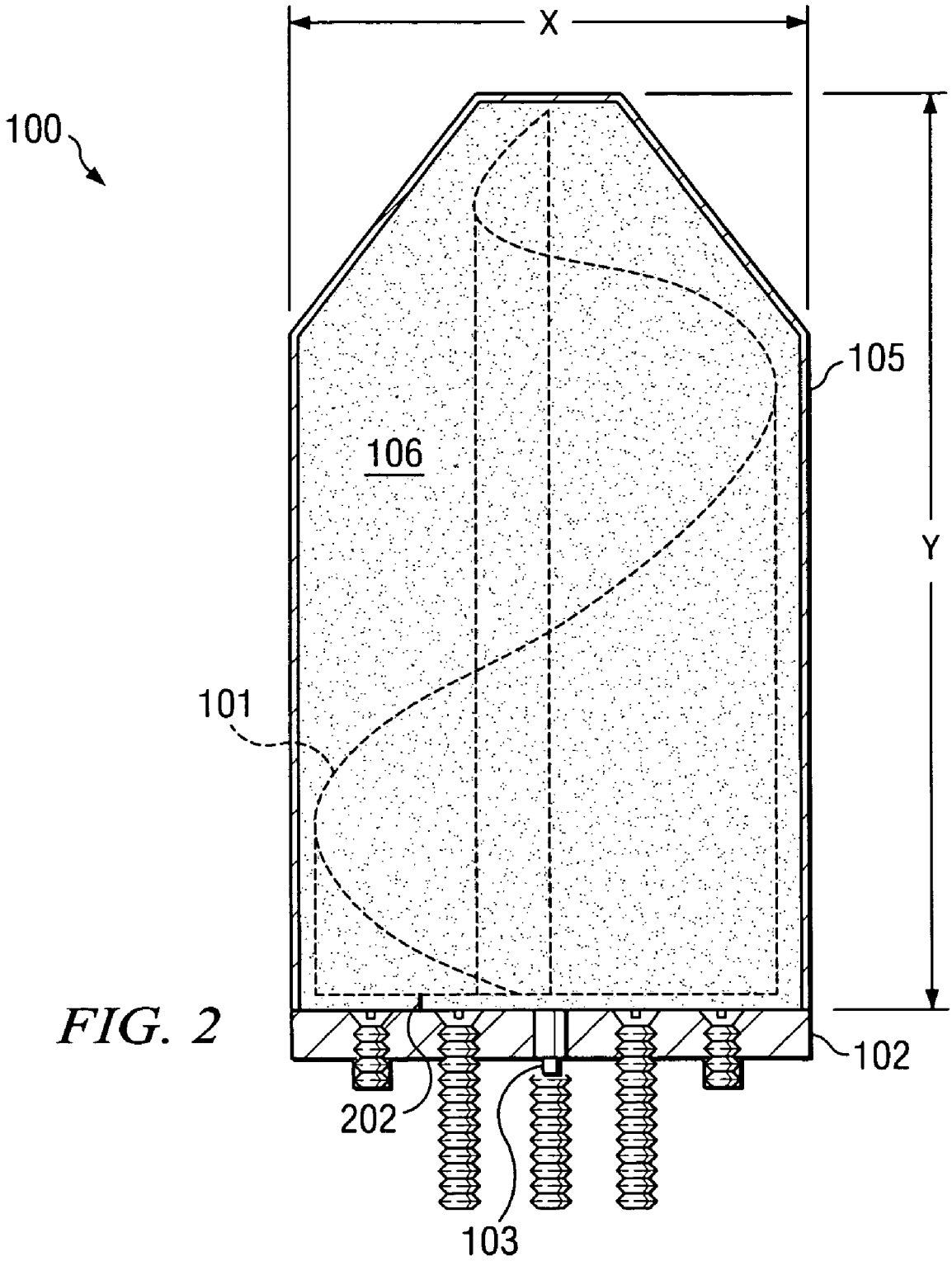
FIG. 2 illustrates another embodiment, in which the antenna element is shorted to the ground plate.

FIG. 2 illustrates another embodiment of antenna 100, with the base of the antenna element 101 having a shorted connection 202 to the ground plane 102. This transforms the impedence of the various radiation modes to values closer to the impedance of the antenna feed line 103. The location of the short 202 (i.e., its distance from the feed point) for best operation is a function of the overall configuration of antenna 100, the desired radiation pattern, and the feed impedance. Embodiments of antenna 100 having a height to base ratio >2.5:1 tend to show improved wide band VSWR performance with short 202.

In addition to providing another adjustable parameter to antenna 100, the short 202 ensures that the antenna element 101 will be at ground potential. Ground potential of antenna element 101 is desirable when there is likely potential for static charge buildup or inadvertant connection to high voltage. The short 202 can be made from a rigid conductive material, and thereby provide support of antenna element 101 to its ground plate 102. The effect on VSWR of the diameter of the short 202 is discussed below.

In operation, antenna 10 may be configured as a monopole and mounted above a conductive ground plane, such as ground plate 102. However, antenna 10 may also be used as elements of other configurations, such as dipole antennas or antenna arrays. The design considerations described herein are for monopole configurations.

For performance evaluation purposes, antenna 100 may be compared to a "fat" monopole, or a flat planar surface equivalent to an unrolled monopole. These configurations represent examples of rolled and unrolled limiting configurations of antenna 100. For example, a fat monopole approximates antenna 100 as the spacing between turns decreases to zero and the number of turns increases for a given base dimension.

Within the design characteristics set out herein, antenna 100 may have a myriad of different configurations with respect to number of turns, height, diameter. A feature of all configurations of antenna 100 is that it has both linear and spiral surfaces continuously connected from the base of the antenna to the tip. A cross section of antenna 100 at any point from the base to the tip produces a spiral. This spiral shortens in length for cross sections taken closer to the tip. At the tip, the spiral reduces in length to a point. As explained below, this combination of linear and curvilinear surfaces produces multiple radiation modes which contribute both to low VSWR and differences in radiation polarization.

Figure 3:
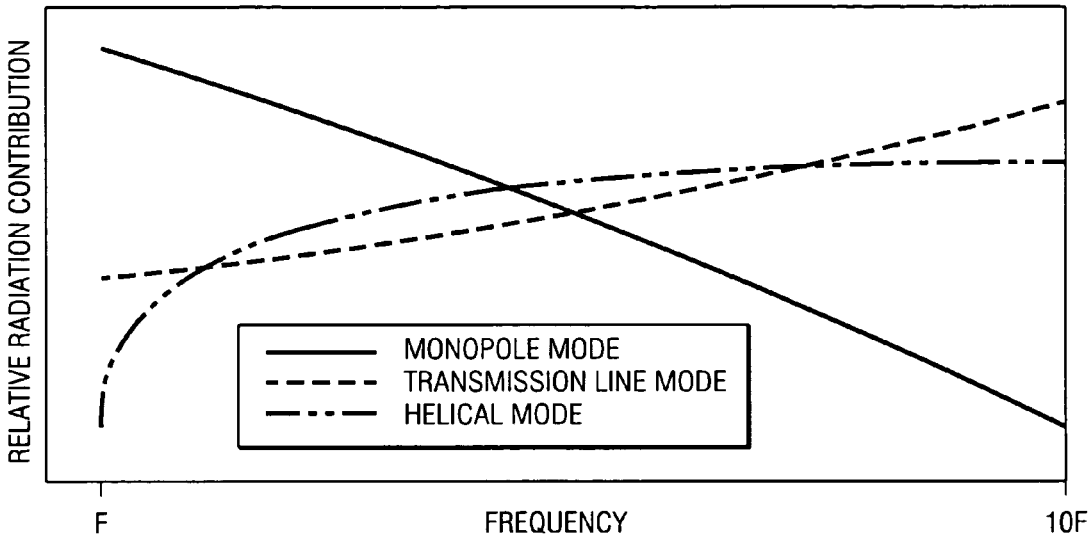
FIG. 3 illustrates the three modes of the antenna.

FIG. 3 illustrates the relative contribution of the three modes (monopole, transmission line, and helical) of antenna 100 to the overall radiation, as a function of frequency. At frequencies where the overall length of antenna 100 is equal to or greater than 0.25λ, the vertically polarized radiation modes predominate. At high frequencies, where the diameter of antenna 100 is greater than 0.5λ, antenna 100 produces circular polarized axial radiation similar to a helical antenna. In addition to the linear mode and helical mode, antenna 100 supports a transmission line mode. The spacing from ground plane 102 to antenna element 101 and turn spacing affect this mode. By locating the feed wire 103 relative to the base of the antenna element 101 at a point where reactance due to the monopole mode is cancelled by the opposite reactance of the transmission line mode, both modes improve the low frequency VSWR. Radiation due to the helical mode does not become significant until the helix diameter is 0.7λ or greater. At some helical diameter, ground spacing, and planar outline of antenna element 101, antenna 100 can produce a low VSWR over more than a 10:1 frequency range.

Through simulation and measurement, it has been determined that the overall length of antenna element 101 usually establishes the lowest low 50 ohm VSWR frequency in a 10:1 bandwidth antenna. Typically, the lowest frequency with VSWR of 3:1 will be set by the overall length of the antenna element (Y) plus the spacing to ground (S). The total of Y+S will be about 0.2λ. But the lowest frequency is also a function of the diameter (D) of the antenna element 101. For height to diameter ratios ranging from 2:1 to 1:2 , the lowest frequency will decrease as the height to diameter ratio decreases.

An antenna 100 with height to diameter ratios greater than 5:1 will establish the low frequency cutoff. The length of antenna element 101 will nominally be 0.2 to 0.25λ. The low frequency cutoff is the lowest frequency with 50 ohm VSWR <3:1. For small height to diameter ratios (<1:1), the low frequency cutoff is more a function of the base length (X) than the height (Y).

A base of any length can produce transmission line resonances. The longer the base length, the more resonances will be produced for a given bandwidth. Although a large number of resonances increases overlapping of modes, the additional complexity of the additional length can be challenging. A good base length is the minimum length that will produce sufficient resonances to lower the VWSR to an acceptable level over the desired bandwidth. Lengths of 0.5 to 1.5 times the height of antenna element 101 are typical. For the shorted base embodiment of FIG. 2, x=1.62Y.

The outside diameter is limited by the length of the base (X) as rolled to form the minimum diameter possible for the desired bandwidth.

The base to ground spacing affects the characteristic impedance of the transmission line mode. The nominal spacing should be 0.5±0.2% of the longest wavelength of interest. Although VSWR is a function of the spacing between the turns of antenna element 101, the effect of VSWR is minimal over that range. Lower values reduce the high frequency VSWR while increasing the low frequency VSWR and vice versa.

In general, the design should provide maximum spacing between the turns of antenna element 101. Some variation may be helpful for shifting the resonance point, but may modify the radiation pattern.

The primary feed point can be at any point on the base of the antenna element 101. The bottom of the innermost edge generally provides a good feed point for an antenna element 101 that is nominally 0.25λ at the lowest frequency of interest. For shorter antenna elements 101, a feed point approximately 10% of the base length for each 10% reduction in element height will give the best match to 50 ohms, but the VSWR becomes worse as the height is reduced.

Feed point diameter is normally not critical unless a short is placed between the antenna element 101 and the ground plane 102. This is the case in FIG. 2. In this case, the ratio of the diameter of the feed point to the diameter of the short 201 becomes an important factor in establishing the VSWR within the first octave.

Antenna element 101 may be formed by laying the material for antenna element 101 on a dielectric material of the desired thickness and rolling the combination to form an antenna element 101 with turn spacing set by the thickness of the dielectric material.

As an alternative to rolling the inner dielectric material, FIGS. 4A–4D illustrate how antenna element 101 may be formed by being wound on mandrels. A set of contiguous mandrel sections 401 may be used to set the spacing for an air-spaced antenna element 101. As each mandrel is set in place next to the previous mandrel, the antenna element 101 is rolled until it is time to place another mandrel section between the turns. This rolling process continues until the antenna element 101 has been wound over the mandrel sections to formed the desired number of turns. In the example of FIGS. 4A–4D, there are ten mandrel sections, but more or fewer could be used.

If the finished antenna element 101 is to be air-spaced and self-supporting, the mandrel sections 401 can then be removed. Alternatively, the mandrel sections 401 can be made from a low loss dielectric material, in which case, the mandrel sections can be left in place. The resulting antenna element 101 and mandrel filler can be enclosed in a radome. An example of a suitable material for mandrel sections 401 is block-molded expanded polystyrene.

Figure 5A:
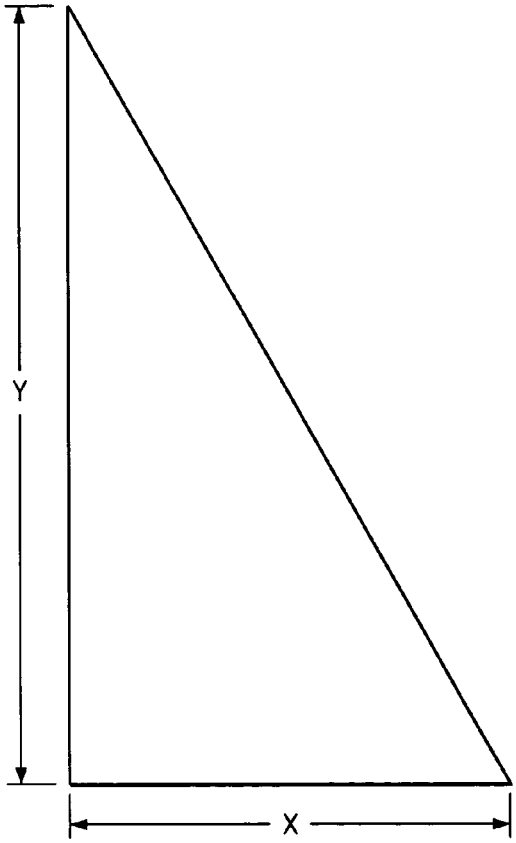
FIGS. 5A–5C illustrate a folded embodiment of the antenna.
Figure 5B:
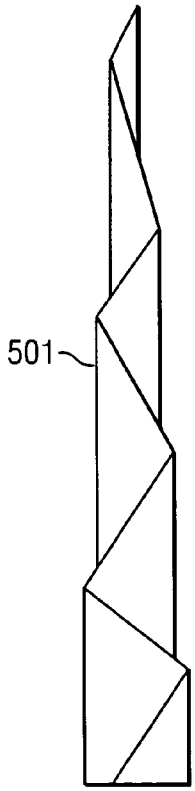
Figure 5C:
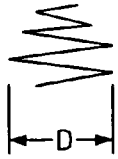
Figure 4A:
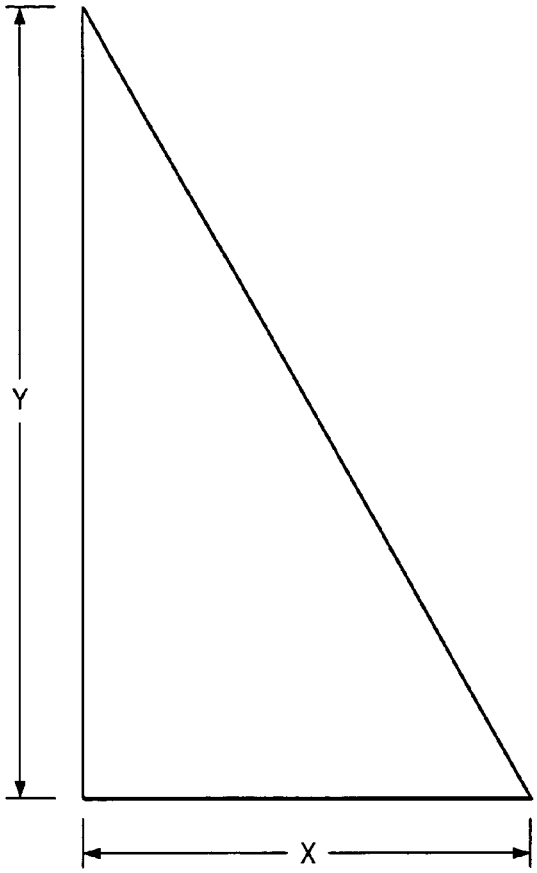
FIGS. 4A–4D illustrate how the antenna may be formed using mandrels.
Figure 4B:
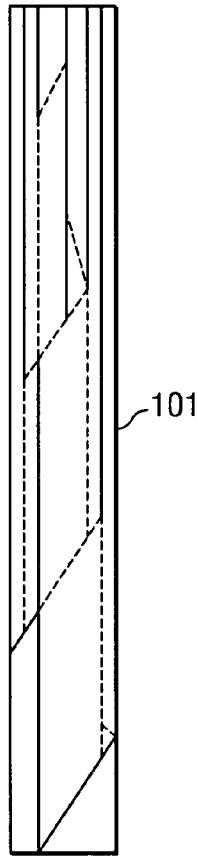
Figure 4C:
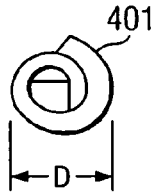
Figure 4D:
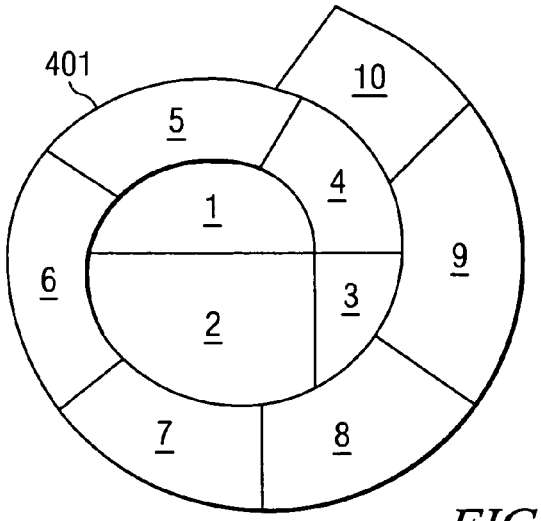

FIGS. 5A–5C illustrate an antenna element 501 having a tapered and folded configuration. For some applications, it may be desirable to suppress the axial mode radiation of antenna 100. This is possible by folding the antenna element 501 rather than rolling it. The planar material from which antenna element 501 is made has a generally right triangular shape as illustrated in FIG. 5A.

The folding of antenna element 501 removes the circular symmetry of antenna 100 and nullifies axial mode radiation. The base transmission line radiation and normal monopole radiation are retained, although because they do not radiate as effectively, the VSWR bandwidth of the folded antenna is not as wide as the rolled antenna. An alternative method of removing the axial mode is to feed two counter-wound antenna elements 101 from a single line source.

Other Embodiments

Although the present invention has been described in detail, it should be understood that various changes, substitutions, and alterations can be made hereto without departing from the spirit and scope of the invention as defined by the appended claims.

What is claimed is:

1. A wideband multi-mode antenna, comprising:

an antenna element made from a substantially triangular sheet of conductive material, the material having a height dimension and a base dimension;

wherein the material has a rolled shape, such that the antenna has the height of the material, one or more turns having spacing between them, and a base having a diameter;

a ground plate spaced from the base of the antenna element;

at least one dielectric spacer for maintaining the space between the base of the antenna and the ground plate;

wherein the antenna element is operable to provide a combination of monopole, transmission line, and helical radiation modes; and a feed point located relative to the base of the antenna element, such that the reactance of the monopole mode is substantially cancelled by the reactance of the transmission line mode.

2. The antenna of claim 1, wherein the antenna is operable between a range of at least 250–2000 Mhz.

3. The antenna of claim 1, wherein the spacing between the turns is uniform.

4. The antenna of claim 1, further comprising a dielectric material between the turns.

5. The antenna of claim 1, wherein the number of turns is less than four.

6. The antenna of claim 1, wherein the conductive material is a mesh material.

7. The antenna of claim 1, wherein the planar material has a curved hypotenuse.

8. The antenna of claim 1, further comprising a radome enclosing the antenna element.

9. The antenna of claim 1, wherein the height is approximately in the range of 0.2 to 0.25 of the wavelength of a low frequency of operation.

10. The antenna of claim 1, wherein the base of the antenna element is approximately 0.5 to 1.5 times its height.

11. The antenna of claim 1, wherein the spacing between the ground plane and the base of the antenna element is approximately 0.5±0.2% of the longest wavelength of its bandwidth.

12. The antenna of claim 1, further comprising a connection for shorting the base to the ground plate.

13. A wideband multi-mode antenna, comprising:

an antenna element made from a substantially triangular sheet of conductive material, the material having a height dimension and a base dimension;

wherein the material has a rolled shape, such that the antenna has the height of the material, one or more turns having spacing between them, and a base having a diameter;

a ground plate spaced from the base of the antenna element; and a conductive connector for shorting the base to the ground plate.

14. The antenna of claim 13, wherein the antenna is operable between a range of at least 250–2000 Mhz.

15. The antenna of claim 13, wherein the spacing between the turns is uniform.

16. The antenna of claim 13, further comprising a dielectric material between the turns.

17. The antenna of claim 13, wherein the number of turns is less than four.

18. The antenna of claim 13, wherein the conductive material is a mesh material.

19. The antenna of claim 13, wherein the material has a curved hypotenuse.

20. The antenna of claim 13, further comprising a radome enclosing the antenna element.

21. The antenna of claim 13, wherein the height is approximately in the range of 0.2 to 0.25 of the wavelength of a low frequency of operation.

22. The antenna of claim 13, wherein the base of the antenna element is approximately 0.5 to 1.5 times its height.

23. The antenna of claim 13, wherein the spacing between the ground plate and the base of the antenna element is approximately 0.5±0.2% of the longest wavelength of its bandwidth.

24. The antenna of claim 13, further comprising a feed wire connected to a point on the base.

25. The antenna of claim 24, wherein the material used for the short is determined relative to the diameter of the feed wire.

26. The antenna of claim 13, further comprising at least one dielectric spacer for maintaining the space between the base of the antenna and the ground plate.

27. A wideband multi-mode antenna, comprising:

an antenna element made from a substantially triangular sheet of conductive material, the material having a height dimension and a base dimension;

wherein the material has a folded shape, such that the antenna has the height of the material, and one or more folds having spacing between them, and such that the helical transmission mode of the antenna element is substantially suppressed.

28. The antenna of claim 27, further comprising a ground plate spaced from the base of the antenna element.

* * * * *